United States Patent [19]

Dorais

[11] 4,301,328

[45] * Nov. 17, 1981

[54] VOICE SYNTHESIZER

[75] Inventor: Mark V. Dorais, Detroit, Mich.

[73] Assignee: Federal Screw Works, Detroit, Mich.

[ * ] Notice: The portion of the term of this patent subsequent to Dec. 5, 1995, has been disclaimed.

[21] Appl. No.: 964,603

[22] Filed: Nov. 29, 1978

Related U.S. Application Data

[63] Continuation of Ser. No. 714,495, Aug. 16, 1976, Pat. No. 4,128,737.

[51] Int. Cl.[3] ..... G10L 1/00

[52] U.S. Cl. ..... 179/1 SA; 179/1 SM

[58] Field of Search ..... 179/1 SA, 1 SF, 1 SM, 179/1 SG

[56] References Cited

U.S. PATENT DOCUMENTS

| | | | |
|---|---|---|---|
| 2,194,298 | 3/1940 | Dudley | 179/1 SG |
| 2,824,902 | 2/1958 | Miller | 179/1 SA |
| 3,102,165 | 8/1963 | Clapper | 179/1 SG |
| 3,704,345 | 11/1972 | Coker | 179/1 SM |
| 3,836,717 | 9/1974 | Gagnon | 179/1 SA |
| 3,908,085 | 9/1975 | Gagnon | 179/1 SG |

OTHER PUBLICATIONS

Flanagan, J. "Speech Analysis, Synthesis and Perception", Springer-Verlag, 1972.

Flanagan et al., "Speech Synthesis", Dowden Hutchinson Ross, Inc., 1973, [Reprinted from J. Ac. Soc. Amer., 43, 822-828 (1968)].

House et al., "The Influence of Consonant Environments", J. Ac. Soc. Amer., vol. 25, Jan. 1953.

C. Gunnar, M. Fant "On the Predictability of Formant Levels etc.", from Readings in Acoustic Phonetics (I. Lehiste, ed.), 1956.

*Primary Examiner*—Mark E. Nusbaum
*Assistant Examiner*—E. S. Kemeny
*Attorney, Agent, or Firm*—Harness, Dickey & Pierce

[57] ABSTRACT

A voice synthesizer that is responsive to sequences of digital input command words to phonetically synthesize human speech. The system includes control circuits that are responsive to the input command words to introduce an articulated silent phoneme into the speech pattern, vary the duration of each phoneme produced, as well as to vary the overall rate and volume of the speech generated. In addition, the design utilizes inflection assignment for individual phonemes and also employs a glottal waveform which is more representative of human glottis action. The invention also incorporates resonant suppression into the vocal tract to simulate the dampening effect due to the opening of the glottis, and provides closer simulation of human energy content at higher frequencies to improve the quality of the speech generated.

4 Claims, 10 Drawing Figures

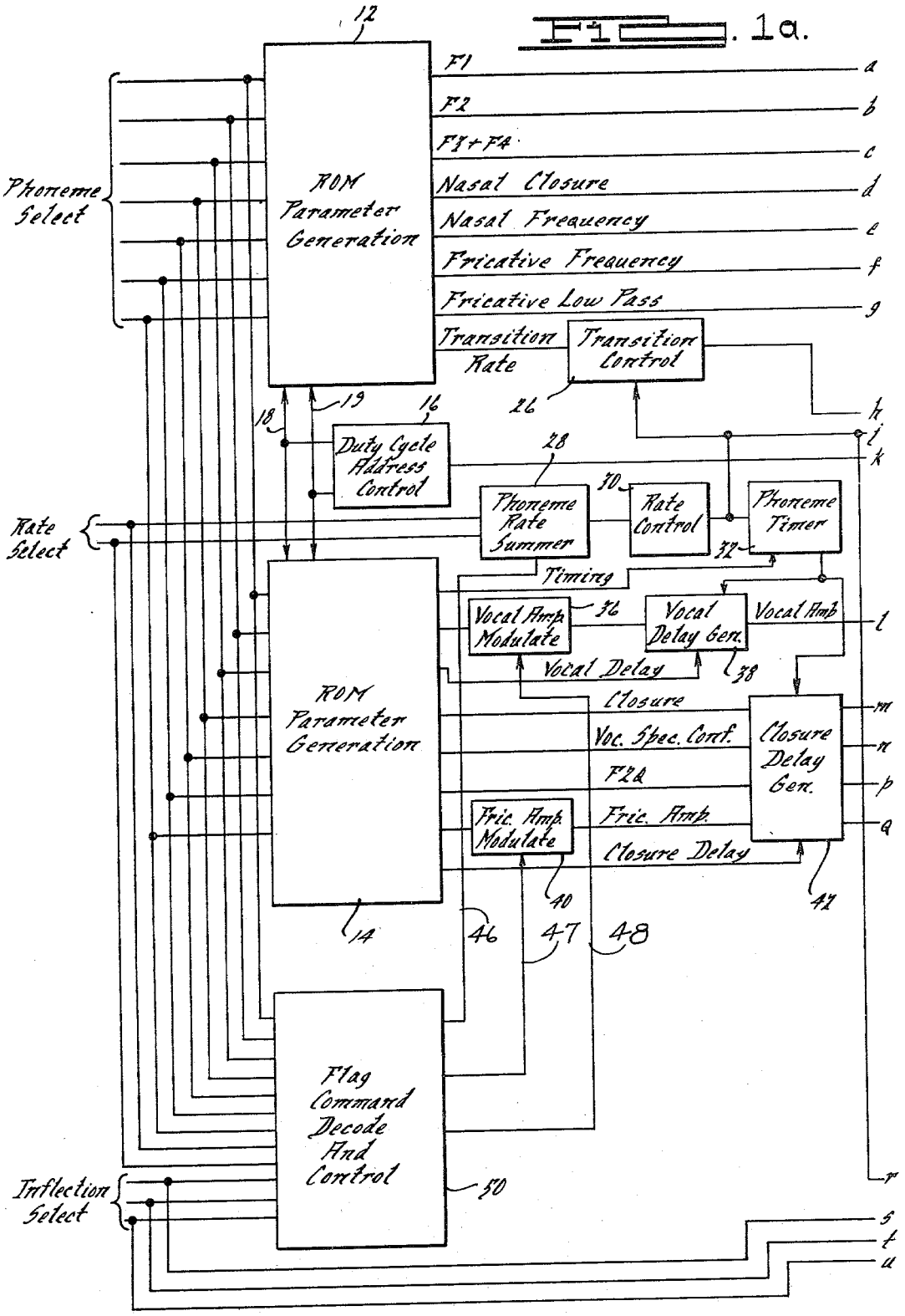
FIG. 1a.
12
ROM Parameter Generation
Phoneme Select
F1
F2
F3+F4
Nasal Closure
Nasal Frequency
Fricative Frequency
Fricative Low Pass
Transition Rate
Transition Control
26
19
18
16
Duty Cycle Address Control
28
Phoneme Rate Summer
30
Rate Control
Phoneme Timer
32
Rate Select
Timing
Vocal Amp. Modulate
36
Vocal Delay Gen.
Vocal Amp
Vocal Delay
38
ROM Parameter Generation
Closure
Voc. Spec. Cont.
FZQ
Fric. Amp.
Closure Delay
Fric. Amp. Modulate
Closure Delay Gen.
40
42
14
46
47
48
Flag Command Decode And Control
50
Inflection Select
a
b
c
d
e
f
g
h
i
k
l
m
n
p
q
r
s
t
u Single Phoneme Silent
To Transition Rate Control And Phoneme Timer
Phoneme Clock Out (PCO)
Fric. Amp. In
Fric. Amp. Out
Vocal Amp. Out
Vocal Amp. In
Clock Signal
"Halt"
Silent Phoneme
Amp. Flag LSB
Amp. Flag MSB
Rate Flag MSB
Rate Flag LSB
Select
Negative Logic In
Zero Decode
Out Set In
Transfer Board (PCI)
Phoneme Clock In
Negative Logic In

VOICE SYNTHESIZER

This is a continuation, of application Ser. No. 714,495, filed Aug. 16, 1976, now U.S. Pat. No. 4,128,737.

BACKGROUND AND SUMMARY OF THE INVENTION

The present invention relates to an improved electronic device for phonetically synthesizing human speech.

Until recently, development in this area had resulted in the production of only extremely complicated and costly devices that generated very unnatural sounding speech. This was primarily attributable to the fact that these first generation synthesizers, with virtually no prior development to build upon, attempted to design a synthesizer that was capable of performing substantially every known function of human speech. Consequently, the systems that resulted were capable of performing few functions satisfactorily.

Typical of the design approach of these early speech synthesizers was the treatment accorded the transitional periods between phonemes. In recognition of the importance of the transitional periods in human speech, some systems devoted substantial effort to the production of various transitional waveforms to simulate the actual human articulation between steady-state phoneme conditions. However, the highly complex circuitry required to analyze, control and integrate the production of these waveforms into smooth flowing phonetic speech made the systems highly impractical for commercial use. The complexity of these systems prompted subsequent research efforts to simplify the original systems.

The relatively recent developments in this area have essentially conceded the fact that the precise duplication of the human speech system is an unattainable goal, and have instead sought to design an approximation of the human speech system that will produce acceptable sounding speech. Without discounting the importance of interphoneme transitions, the principal result of this development has been the change from the highly complex system of interphoneme transitions previously discussed, to a simplified approach that employs relatively slow-acting filters that smooth the abrupt variations in the control parameters that determine the steady-state conditions of individual phonemes.

Accordingly, it is the primary object of the present invention to provide an improved speech synthesizer that not only is relatively uncomplicated and inexpensive, but is also capable of producing remarkably natural sounding speech. In addition, the present system is designed to be readily adaptable to a wide range of commercial uses.

Furthermore, it is another object of the present invention to provide a speech synthesizer that will produce very natural sounding speech without the aid of an experienced programmer. This makes the present system particularly adapted for use in connection with a digital computer as a test-to-audio converter.

The preferred embodiment of the present invention comprises a system that is adapted to convert digitized data, such as the output from a computer or other digital device, into electronically synthesized human speech by producing an integrating together the phonemes and allophones of speech. The basic digital command word which drives the present voice system preferably comprises twelve bits. Seven of these bits are allocated to phoneme selection to define a particular phoneme, pause or control function, thus providing a maximum of $2^7$ or 128 different commands. The increased capacity over that required to produce the basic phoneme sounds allows the present system to reproduce a greater variety of allophones which represent basic phonemes that are slightly altered to integrate more appropriately into the variability of speech. For example, the "ae" phoneme in the word "happen" is different than in the word "bat". Similarly, the beginning "k" phoneme in the word "kick" is different than the "k" phoneme in the word "quit". In addition, the increased capacity permits the present system to devote various commands to the production of phonemes unique to certain foreign languages, thus providing the system with the capability of producing high quality foreign speech as well.

Three of the twelve data bits in the input command word are used for inflection control. This provides $2^3$ or eight different inflection levels per phoneme, which gives the system the ability to reproduce the smooth and subtle movements in pitch characteristic of human speech. The remaining two data bits in each input command word are used to vary the rate of phoneme production, thereby providing four possible time intervals for each phoneme produced, allowing phonemes to be more contextually precise in time duration.

The seven bits that define the particular phoneme are provided to an input control circuit which produces a plurality of predetermined control signal parameters that electronically define the phoneme selected. The control signals produced by the input control circuit are preferably in the form of serialized binary-weighted square wave signals whose average values are equivalent to the analog control signals they represent. By producing digital representations of analog signals, the present system avoids the necessity of employing complicated electronic circuitry required to accurately control analog signals.

The control signal parameters from the input control circuit are first passed through a series of relatively slow-acting transition filters which smooth the abrupt amplitude variations in the signals. From there, the control signals are provided to various dynamic articulation control circuits which combine and process the parameters to produce excitation control and vocal tract control signals analogous to the muscle commands from the brain to the vocal tract glottis, tongue and mouth in the human speech mechanism.

The system further includes vocal and fricative excitation sources which receive the excitation control signals that determine the various signal characteristics of the basic voiced and unvoiced signal quantities in human speech. The vocal excitation source produces a glottal waveform tht mimics the glottis as it vibrates in the human vocal tract. The fricative source simulates the sound of air passing through a restricted opening as occurs in the pronounciation of the phonemes "s", "f" and "h".

The vocal and fricative excitation signals, as well as the vocal tract control signals, are suppliied to a series of cascaded resonant filters which simulates the multiple resonant cavities in the human vocal tract. The control signals adjust the characteristic resonances of the filters to produce an audio signal having the desired frequency spectrum.

The two rate bits in the original input command word are converted to a duty cycle rate control signal that is provided to the phoneme clock which defines the time interval of the particular phoneme generated. The three remaining inflection bits in the input command word are used to generate an analog inflection control signal that is provided to the vocal excitation source to determine the "pitch" or frequency of the glottal waveform.

The preferred form of the present invention also includes circuitry that automatically alters the inflection levels of various phonemes in accordance with certain parameter control signals. As a result, the voice generated by the present system is less monotonic and more natural sounding than those of previous systems, especially when manual programming of inflection is impractical or not used.

In addition, the present invention utilizes a novel glottal waveform that more accurately simulates the actions of the human glottis. The new glottal waveform comprises a truncated sawtooth waveform which produces both odd and even harmonics. Also included in the glottal waveform is the addition of a high frequency formant that increases the spectral energy of the waveform at high frequencies. The increased energy at high frequencies improves the relative spectral amplitude of the lower formants as well.

The vocal tract of the present invention has also been improved by adding movement to the fourth order resonant filter in the vocal tract. This is particularly significant because it is accomplished without requiring the generation of additional control parameters that would increase the complexity of the system. Rather, the fourth resonant filter is made variable under the control of the same control signal that determines the location of the third resonant pole.

The present invention additionally incorporates into the vocal tract the suppression of vocal resonances to simulate the reduced impedance that is reflected in the human vocal tract when the glottis is opened. In particular, the present system includes a circuit that is adapted to produce a variable pulse-width square signal whose duty cycle is proportional to the magnitude of the glottal waveform. The glottal suppression duty cycle signal is then provided to a series of analog control gates connected across the bandpass sections of the first three resonant filters in the vocal tract. The effect is to dampen resonance due to open glottis by increasing the band-widths of the resonant filters as the magnitude of the glottal waveform increases.

Finally, the present invention includes a flag command decode and control circuit which provides the programmer with the ability to vary the overall volume and speech rate of the audio output. The circuit is also capable of introducing into the speech pattern a silent phoneme which is articulated in the same manner as a voiced phoneme to add to the naturalness of the speech generated. As will subsequently be described in greater detail, the silent phoneme is intended primarily for use in combination with certain phonemes which sound more natural if their articulation pattern is formed prior to, or maintained for a brief period after, the application of excitation energy to the vocal tract.

The flag circuit is designed to be activated by a specific 7-bit phoneme code that distinguishes the flag command from other phoneme commands. The remaining five bits in the flag command word are then used to select the sound level and speech rate desired, and to indicate whether the succeeding phoneme period is to be silent. In addition, the flag command phoneme is adapted to consume a very brief time interval so that the normal phonetic makeup of a message is not noticeably altered. This is accomplished by latching the desired flag information and commanding the synthesizer to immediately proceed to the next phoneme.

In reading the following detailed description of the preferred embodiment, however, it is to be understood that the practice of the present invention is not limited to the exact system described herein. Rather, the concepts of the present invention are equally applicable to other basic speech systems without departing significantly from the teachings of the present invention.

BRIEF DESCRIPTION OF THE DRAWING

The detailed description of the preferred embodiment of the present invention makes reference to the following drawings of which:

FIG. 1*a* and 1*b* are a block diagram of a voice synthesizer according to the present invention;

DETAILED DESCRIPTION OF THE PREFERRED EMBODIMENT

Figure 1B:
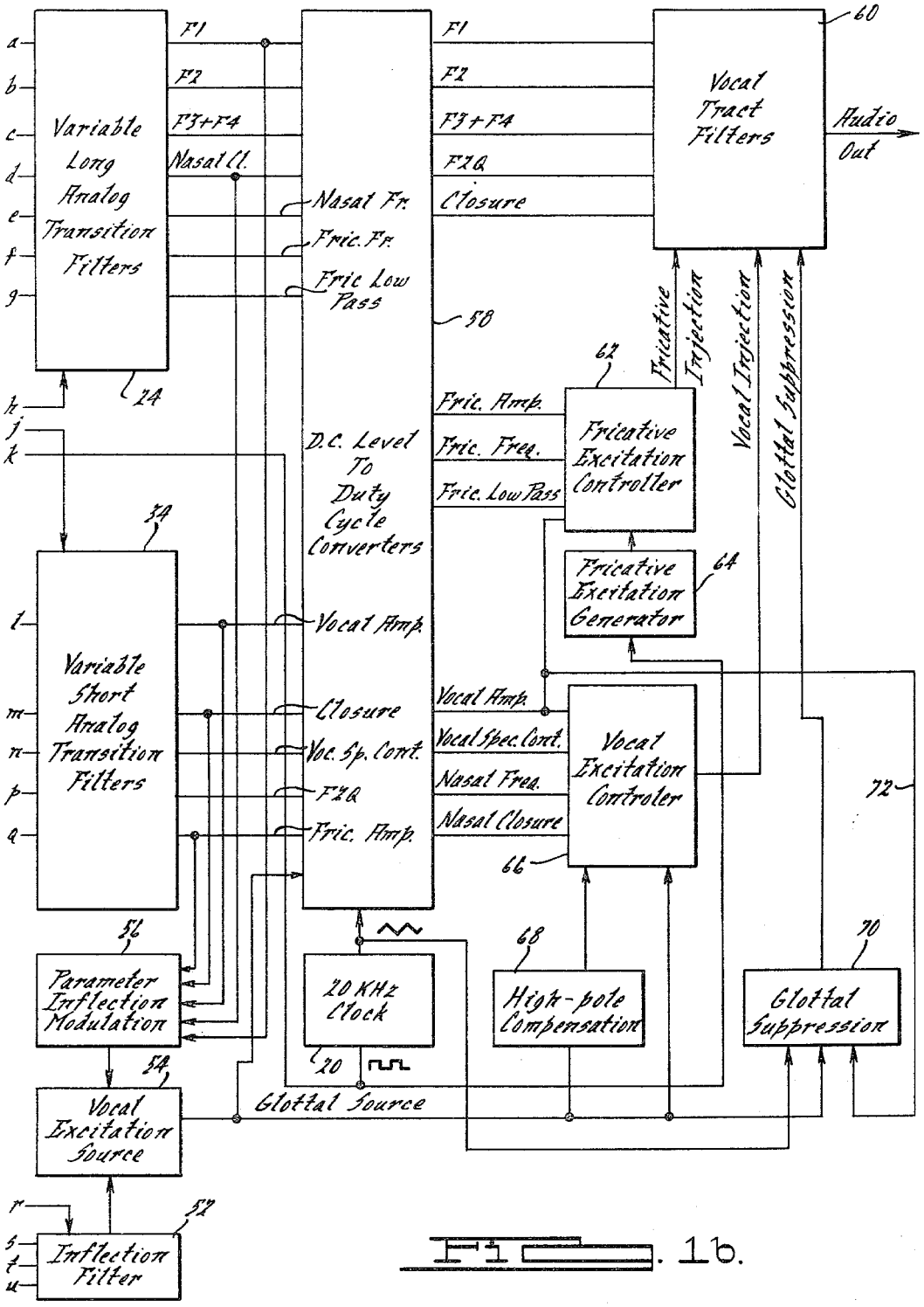

Looking to FIG. 1, a block diagram of a voice synthesizer embodying the teachings of the present invention is shown. It is to be understood that the practice of the present invention is not limited to the specific voice synthesizer shown in FIG. 1, but may be readily adapted to other systems without departing from the scope of the invention. As previously explained, the present system is preferably driven by a twelve bit digital input command word. Seven of the twelve input bits are used for phoneme selection and are provided to a pair of read-only memories (ROMs) 12 and 14. For each of the 128 possible phonemes which can be identified by the seven phoneme select bits, there is stored in ROMs 12 and 14, sixteen different parameters which electronically define the articulation pattern of each phoneme. In addition, each parameter requires four bits of resolution to produce the serialized binary-weighted digital control signals previously mentioned. Therefore, the total read-only memory bit requirement equals $16 \times 4 \times 128$ or 8,192 bits. This requirement cn be satisfied by using any number of parallel connected ROMs that will provide the necessary capacity. The system shown in FIG. 1 contains two ROMs 12 and 14, each comprising 512×8 bit matrix for a total of 4,096 bits each. Of course, a single read-only memory with a capacity of 8,192 bits could be substituted for the two ROMs 12 and 14 shown.

The ROMs 12 and 14 are clocked under the control of a duty cycle address circuit 16 which provides the proper timing sequence on lines 18 and 19 required for ROMs 12 and 14 to generate the serialized binary-weighted duty cycle parameter control signals previously mentioned. The duty cycle address control circuit 16 is connected to a clock circuit 20 which produces a square wave output signal at a frequency of 20 KHz. The 20 KHz square wave clock signal received by the duty cycle address control circuit 16 is segregated into 15 pulse groups which are further divided into time segments of 8, 4, 2 and 1 clock pulses. For each group of 15 clock pulses received, the duty cycle address control circuit 16 provides a HI output signal on line 18 or the MSB line during the eight and four time segments, and a HI output on line 19 or the LSB line during the eight and two time segments.

The serialized binary-weighted digital control parameters generated by ROMs 12 and 14 preferably contain four bits of resolution. In other words, for each phoneme parameter, ROMs 12 and 14 contain four bits of information, thereby providing $2^4$ or 16 possible values per parameter. To provide the four bits with their appropriate binary weight, the first or most significant of the four serialized output bits in the control parameter is generated when both the signals on lines 18 and 19 are HI, the second bit when the LSB line is LO and the MSB line is HI, the third bit when the LSB is HI and MSB line is LO, and the fourth or least significant of the four bits when the MSB and LSB lines are both LO. Thus, it can be seen that the first or most significant bit is produced for a period of eight clock pulses, the second bit is produced for a period of four clock pusles, the third bit is produced for a period of two clock pulses, and the fourth bit is produced for a period of one clock pulse. In this manner, an analog signal can be digitally represented as the average magnitude of the control signal over a fifteen clock pulse period.

Althrough known to the art, the particular control signal parameters generated by ROMs 12 and 14 on lines 22 will be briefly explained herein to provide a better understanding of the operation of the present system.

The F1 and F2 control signals determine the locations of the resonant frequency poles in the first two variable resonant filters in the vocal tract 60. As will subsequently be described is greater detal, the F3+F4 control signal determines the locations of the frequency poles in both the third and fourth order variable resonant filters in the vocal tract 60. The nasal closure and nasal frequency control signals are generated whenever the voiced quantities "n", "m", or "ng" are present to simulate the decrease in energy which occurs in the vocal energy spectrum when these voiced phonemes are spoken. More specifically, the nasal closure control signal determines the amount of vocal energy to be removed, and the nasal frequency control signal establishes the frequency at which the energy is to be decreased. The fricative frequency and fricative low pass control signals also work in conjunction with one another and are generated whenever phonemes with fricative energy, such as "f" and "s" are present. These control signals serve to spectrally shape the fricative excitation energy prior to injection into the vocal tract 60. In particular, the fricative low pass control signal determines the frequency above which the broad-banded fricative excitation energy will be excluded, and the fricative frequency control signal determines the frequency at which the maximum voiceless energy will occur. The transition rate control signal is generated for each phoneme and, together with the output from the rate control circuit 30 to be subsequently described, establishes the transition rate between the steady-state conditions of the above-mentioned control signals. The timing control signal is also generated for each phoneme and in combination with the output from the rate control circuit 30, establishes the period of production for each phoneme. A vocal amplitude control signal is generated whenever a phoneme having a voiced component is present. The vocal amplitude control signal controls the intensity of the voiced component in the audio output. The vocal delay control signal is generated during certain fricative-to-vowel phonetic transitions wherein the amplitude of the fricative constituent is rapidly decaying at the same time the amplitude of the vocal constituent is rapidly increasing. As will be more fully explained in connection with the vocal delay generator circuit 38, the vocal delay control signal identifies those instances when it is desirable for the vocal delay generator to delay the transmission of the vocal amplitude control signal. The closure control signal is used to simulate the phoneme interaction which occurs, for example, during the production of the phoneme "b" followed by the phoneme "e". In particular, the closure control signal, when generated, causes an abrupt amplitude modulation in the audio output that simulates the buildup and sudden release of energy that occurs during the pronunciation of such phoneme combinations. The vocal spectral contour control signal is another control signal that spectrally shapes the vocal energy spectrum. Specifically, the vocal spectral contour control signal controls a first order low pass filter that suppresses the vocal energy injected into the vocal tract, with maximum suppression occurring in the presence of purely unvoiced phonemes. The F2Q control signal varies the "Q" or bandwidth of the second order resonant filter (F2) in the vocal tract 60, and is used primarily in connection with the production of the nasal phonemes "n", "m", and "ng". Nasal phonemes typically exhibit a higher amount of energy at the first formant (F1), and a substantially lower and broader energy content at the higher formants. Thus, during the presence of nasal phonemes, the F2Q control signal is generated to reduce the Q of the F2 resonant filter which, due to the cascaded arrangement of the resonant filters in the vocal tract 60, prevents significant amounts of energy from reaching the higher formants. The fricative amplitude control signal is generated whenever a phoneme having an unvoiced component is present, and is used to control the intensity of the unvoiced component in the audio output. Finally, the closure delay control signal is generated during certain vowel-to-fricative phonetic transitions wherein it is desirable to delay the transmission of the closure, vocal spectral contour, F2Q and fricative amplitude control signals in the same manner as that discussed in connection with the vocal delay control signal.

The output control signal parameters from ROM 12 are applied to a first series of relatively slow-acting transition filters 24. The transition filters 24 are purpose-fully designed to have a relatively long response time in relation to the steady-state duration of a typical phoneme so that the abrupt amplitude variations in the output control signals from ROM 12 will be eliminated. Thus, the transition filters 24 provide gradual changes between the steady-state levels of the control signal parameters to simulate the smooth transitions between phonemes present in human speech. The response time of the transition filters 24 is preferably made variable under the control of the output signal from the transition control circuit 26. The transition control circuit 26 combines the transition rate control signal from ROM 14 with the output signal from rate control circuit 30 to produce a fixed frequency, variable pulse-width square wave signal whose percentage duty cycle determines the response time of the transition filters 24.

The two rate select bits from the twelve bit input command word are provided directly to a phoneme rate summing circuit 28. The rate summer 28 combines the rate select bits with the speech rate output signal on line 46 from the flag command and control circuit 50 and supplies the summation to the rate control circuit 30. The rate control circuit 30 produces a variable pulse-width square wave output signal whose percentage duty cycle is dependent in part upon the magnitude of the output signal from the phoneme rate summer 28. The speech rate duty cycle signal from the rate control circuit 30 is provided to the transition control circuit 26, the phoneme timing circuit 32, an inflection filter 52, and a second series of relatively slow-acting transition filters 34. As stated previously, the transition control circuit 26 combines the output signal from the rate control circuit 30 with the transition rate control signal from ROM 14 to produce the duty cycle transition signal which determines the response time of the first series of slow-acting transition filters 24.

The phoneme timer 32, which also receives the speech rate duty cycle signal from the rate control circuit 32, is adapted to produce a ramp signal that varies from five volts to zero volts in a time period that determines the duration of phoneme production. The slope of the ramp signal produced by the phoneme timer 32 is dependent upon both the duty cycle of the speech rate signal from the rate control circuit 30 and value of the phoneme timing control signal from ROM 14. It is to be understood that the phoneme timing control signal from ROM 14 effects the relative production period of each individual phoneme, while the rate control circuit 30 determines the overall rate of phoneme production, i.e. speech rate.

The vocal amplitude control signal from ROM 14 is applied to a vocal amplitude modulation circuit 36 which modulates the amplitude of the vocal amplitude control signal in accordance with the magnitude of the volume control signal received on line 48 from the flag command and control circuit 50. The modulated vocal amplitude control signal is applied to a vocal delay generator 38 which delays the transmission of the vocal amplitude control signal for a predetermined time period less than the duration of a single phoneme time interval whenever a vocal delay control signal is provided by ROM 14.

Similarly, the fricative amplitude control signal from ROM 14 is applied to a fricative amplitude modulation circuit 40 which modulates the amplitude of the fricative amplitude control signal in accordance with the magnitude of the volume control signal received on line 47 from the flag command and control circuit 50. The modulated fricative amplitude control signal is applied to a closure delay generator 42 which functions in the same manner as the vocal delay generator 38. In addition, the closure, vocal spectral contour, and F2Q control signals are also applied to the closure delay generator 42 which similarly delays the transmission of the aforementioned control signals for a predetermined time period less than the duration of a single phoneme time interval whenever a closure delay control signal is provided by ROM 14. Note that the time delays introduced by the vocal delay generator 38 and the closure delay generator 42 are dependent upon the time interval of the particular phoneme being generated, as determined by the ramp output signal from phoneme timer 32.

As previously discussed, the vocal delay generator 38 and the closure delay generator 42 insure that the proper timing sequence is provided between certain fricative-to-vowel and vowel-to-fricative phonetic transitions. For example, the vowel-to-fricative transition in the pronunciation of the letter "s" includes a vocal constituent whose amplitude rapidly declines at the same time that the amplitude of the fricative constituent would normally be rapidly increasing. The closure delay generator 42, in this case, will delay the transmission of the fricative constituent with respect to the vocal constituent so that the rapid increase in the fricative energy level will not be "lost" in the rapid decline of the vocal energy level. However, the production of the fricative constituent will be delayed somewhat in time.

The outputs from vocal delay generator 38 and closure delay generator 42 are applied to a second series of relatively slow-acting transition filters 34 which smooth the abrupt amplitude variations in the control signals in the same manner as that previously described with respect to transition filters 24. As with the first series of transition filters 24, the response time of the second series of transition filters 34 is also controlled by the speech rate duty cycle signal from rate control circuit 30. However, it will be noted that the response time of the second series of transition filter 34 is controlled only by the speech rate signal from the rate control circuit 30, while the response time of the first series of transition filters 24 is additionally controlled by the transition rate control signal from ROM 12. This is because the transitional timing of the control signal parameters applied to the second series of transition filters 34 is not as critical as the timing of the control signal parameters applied to the first series of transition filters 24, and therefore, does not require the precise timing control provided by the transition control signal.

The three inflection select bits from the twelve bit input command word are provided directly to an inflection filter 52 which combines the binary weighted bits into a single analog inflection control signal. In addition, the inflection filter 52 smooths the abrupt amplitude variations in the inflection control signal in the same manner as that previously described with respect to transition filters 24 and 34. The response time of the inflection filter 52 is also controlled by the speech rate duty cycle signal from the rate control circuit 30.

The output from the inflection filter 52 is provided to a vocal excitation source 54 which generates the voiced excitation energy or glottal waveform. The output from the inflection filter 52 determines the pitch of the vocal energy which corresponds to the fundamental frequency ($F\phi$) of the glottal waveform. In the preferred embodiment of the present invention, the glottal waveform generated by the vocal excitation source 54 comprises essentially a sawtooth waveform with the negative portion of the signal removed. As will subsequently be explained in greater detail, this novel glottal waveform more closely simulates the actions of the human glottis, and therefore improves the naturalness of the speech generated.

In addition, to provide a certain degree of automatic inflection control heretofore unavailable in prior art systems, the fundamental frequency of the glottal waveform generated by the vocal excitation source 54 is made variable in response to changes in the F1, nasal closure, vocal amplitude, closure, and fricative amplitude control signals. More specifically, the aforementioned control signals are provided to a parameter inflection modulation circuit 56 which modulates the effect of the control signals on the fundamental frequency of the glottal waveform.

The outputs from transition filters 24 and 34 are provided to a series of analog-to-duty cycle converters 58. In particular, the converters 58 comprise a plurality of comparators having one input thereof connected to receive a 20 KHz triangle signal from clock circuit 20, and their other input connected to one of the control signals from the transition filters 24 and 34. The comparators are adapted to produce variable pulse width, fixed frequency square wave signals whose percentage duty cycle corresponds to the magnitude of the correlative control signals received at their inputs.

The F1, F2, F3, F4, F2Q, glottal suppression, and closure duty cycle control signals from converters 58 are applied directly to the vocal tract filter unit 60. Vocal tract filter 60 essentially comprises five serially connected resonant filters, four of which are made variable, an analog closure gate, and a 20 KHz filter. The analog closure gate is responsive to the closure duty cycle control signal to modulate the amplitude of the audio output, and the 20 KHz filter is operative to exclude the effects of the clock signal on the audio output. The F1, F2 and F3 variable resonant filters provide the first three resonant formants in the energy spectrum of the audio output and are each tunable under the control of their respective duty cycle control signals. The F1 resonant filter is tunable over a range of frequencies extending from 250 Hz to approximately 800 Hz. The F2 resonant filter is tunable over the frequency range of 760 Hz to 2400 Hz. And the F3 resonant filter is tunable within the frequency range of 1200 Hz to 2550 Hz. As will subsequently be explained in greater detail, the F4 resonant filter, which provides the fourth order formant in the audio output, is also made variable without requiring the generation of an additional control signal. More specifically, the F4 resonant filter is tuned by the same control signal that tunes the F3 resonant filter, and is made variable over a frequency range of from 2400 Hz to 3700 Hz. The F5 resonant filter is a fixed-pole filter that introduces a fifth level formant in the audio output at approximately 4400 Hz.

The F2 and F5 resonant filters in the vocal tract filter unit 60 are injected with the unvoiced excitation signal quantity from a fricative excitation controller 62. Only the F2 and F5 resonant filters receive fricative energy because it has been found to be sufficient to inject fricative energy only at these two points in the vocal tract in order to accurately simulate the frequency spectrums of all the fricative phonemes. The fricative excitation controller 62 receives the unvoiced or fricative excitation signal from the fricative excitation generator 64 which produces the unvoiced phoneme quantity of human speech. The fricative excitation controller 62 comprises essentially a group of analog control devices which alter the amplitude, frequency and low-pass signal characteristics of the fricative excitation signal in accordance with the duty cycle control signals received from the analog-to-duty cycle converters 58. The fricative excitation generator 64 consists of a random noise source which simulates the sound of air passing through a restricted opening, such as occurs in the pronunciation of the phonemes "s", "f", and "h".

The voiced signal quantity from the vocal excitation source 54 is also provided to the vocal tract filter unit 60 via a vocal excitation controller 66. The vocal excitation controller 66 similarly comprises a group of analog control devices which alter the signal characteristics of the voiced excitation signal in accordance with the vocal amplitude, vocal spectral contour, nasal frequency, and nasal closure duty cycle control signals received from converters 58.

As will subsequently be explained in greater detail, the vocal energy injected into the vocal tract filter unit 60 includes an additional formant which is added to the voiced excitation signal by a high-pole compensation circuit 68 to increase the spectral energy of the signal at high frequencies. In addition, the voiced signal quantity is provided to a glottal suppression circuit 70 which introduces resonant suppression into the vocal tract 60 to simulate the opening of the glottis in human speech. The glottal suppression circuit 70 is adapted to produce a duty cycle control signal that is effective to dampen the resonance of the F1, F2 and F3 resonant filters. As will subsequently be explained in greater detail, the glottal suppression circuit 70 causes maximum dampening during those portions of the glottal waveform corresponding to the open glottis. Furthermore, since the human glottis is active only during the production of voiced phonemes, the glottal suppression unit 70 is adapted to provide its suppression duty cycle signal to the vocal tract 60 only during the production of voiced phonemes, as indicated by the receipt of a vocal amplitude signal on line 72.

Finally, it will be noted that the present invention includes a flag command decode and control circuit 50 which is adapted to provide overall rate and amplitude control of the audio output. As will be more fully explained in connection with the description of FIG. 6, the overall speech rate and/or volume of the audio output can be programmably varied by "calling" the flag command circuit by its preselected seven bit phoneme "name" and entering the desired rate and/or volume changes via the rate select and inflection select bits, respectively. In addition, the flag command decode and control circuit 50 has the capability of introducing an articulated silent phoneme into the speech pattern to more recalistically simulate human speech.

Figure 2:
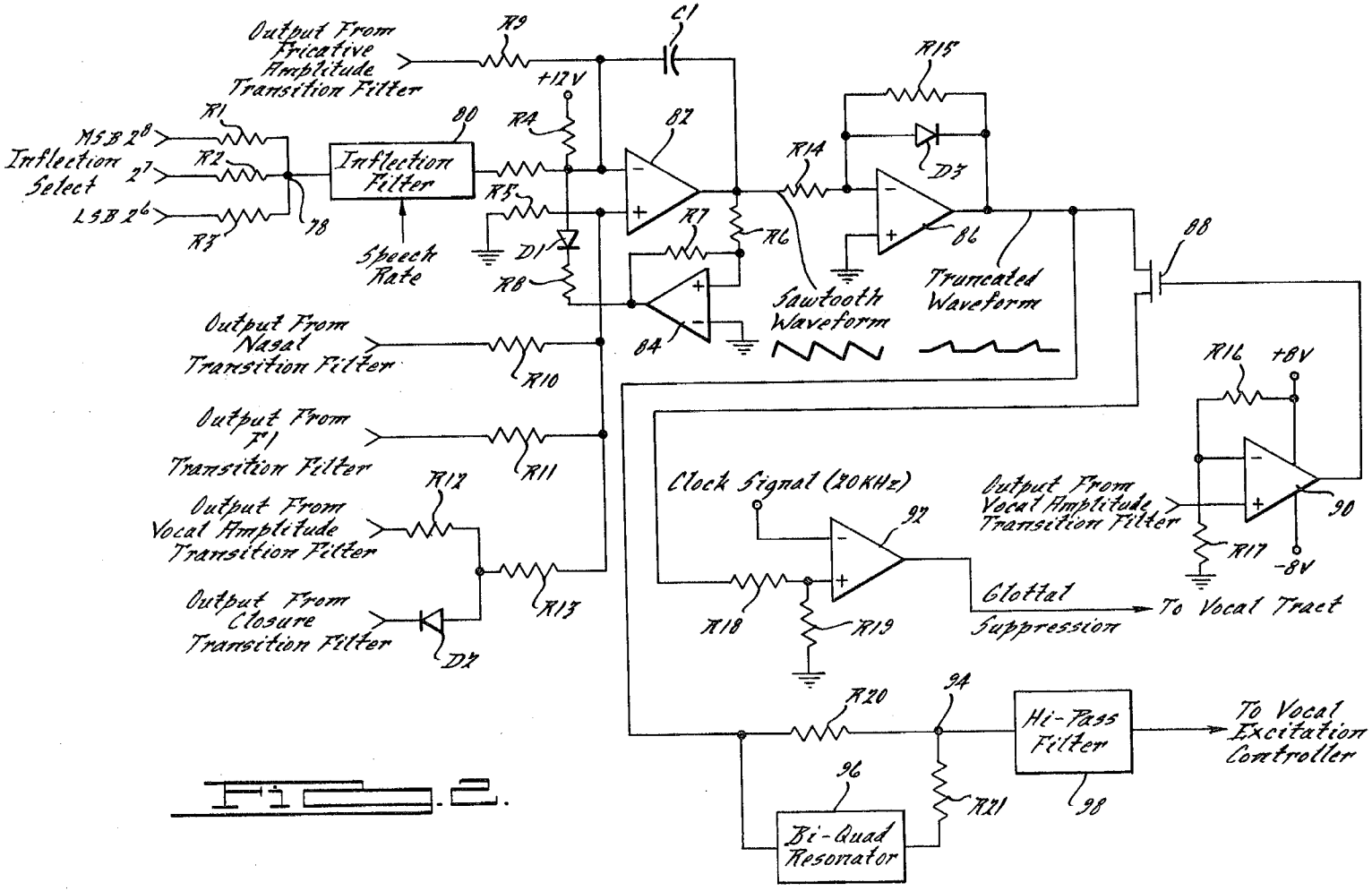
FIG. 2 is a circuit diagram of part of the system illustrated in FIG. 1.

Looking at FIG. 2, a detailed circuit diagram of pertinent sections of the system illustrated in FIG. 1 is shown. As previously mentioned in connection with the description of the block diagram in FIG. 1, the present system preferably assigns three of the twelve bits in the input command word to the programming and control of the inflection or pitch of the audio output. The three inflection bits improve the speech quality capability of the present system by increasing the variety of discrete inflection levels available when programming. This is accomplished by connecting each of the three input data inflection bits $2^6$, $2^7$, and $2^8$ to a weighting resistor R1, R2 and R3 respectively, and tying the weighting resistors to a common summing junction 78. The output from the summing junction 78 is then provided to the inflection filter 80. The resistance values of resistors R1, R2 and R3 are selected to provide eight possible inflection levels. Specifically, weighting resistor R1 connected to the least significant bit 26 has a value equal to four times the value of weighting resistor R3 connected to the most significant bit 28 and twice the value of weighting resistor R2 connected to the middle inflection bit $2^7$. Thus, it can be seen that the contribution of inflection bit $2^8$ to the magnitude of the signal at summing junction 78 is twice that of inflection bit $2^7$ and four times that of inflection bit $2^6$. Inflection filter 80 comprises a relatively slow acting filter whose response time is controlled by the speech rate duty cycle signal from the rate control circuit. The relatively slow response time of inflection filter 80 smooths the abrupt amplitude variations in the signal from summing junction 78 that occur when the status of the input inflection bits are changed.

As will be recalled from FIG. 1, the output from the inflection filter is provided to the vocal excitation source which generates the basic voiced phoneme quantity analogous to the vibrating glottis in the human vocal tract. The vocal excitation source comprises essentially an integration amplifier 82 and amplifier 86. The output from the inflection filter 80 is provided through a coupling resistor to the negative input of integrator 82. The negative input to integrator 82 is also connected through resistor R4 to a bias potential of +12 volts. The positive input of integrator 82 is tied to ground through resistor R5, and the output from integrator 82 is returned to its negative input through feedback capacitor Cl. Since the integration of a constant potential signal is a ramp signal, it can be seen that integrator 82 will produce a negative-going ramp signal whose slope is proportional to the potential of the signal at its negative input. Note also that the output from integrator 32 is returned to its negative input through a feedback circuit comprising resistors R6, R7 and R8, diode D1 and amplifier 84. The purpose of this feedback circuit is to reset the output of integrator 82 to its original potential to start a new cycle. Thus, as will be apparent to those skilled in the art, integrator 82 will produce a sawtooth waveform, as shown in the accompanying signal diagram, whose frequency is related to the magnitude of the signal from the inflection filter 80.

Voiced signal quantities having sawtooth waveforms have been recognized by the prior art as producing more natural sounding speech than other types of previously employed waveforms, such as the impulse function. This is primarily due to the ability of the sawtooth waveform to produce a wider amplitude distribution of both odd and even harmonics. However, the basic sawtooth waveform fails to account for the three fundamental actions of the human glottis; i.e. (1) the opening of the glottis, (2) the closing of the glottis, and (3) the closed glottis. To more accurately simulate the actions of the human glottis, and therefore to provide a more natural sounding voice, the glottal waveform of the present invention is further modified by connecting the output of integrator 82 through a resistor R14 to the negative input of amplifier 86. The positive input of amplifier 86 is tied to ground. The output from amplifier 86 is returned to its negative input through a diode D3 and a shunt resistor R15. The diode D3 acts as a feedback short for signals exceeding its breakdown voltage, and resistor R15 provides linear feedback for signals to resistor R14 that are negative with respect to ground. Thus, it can be seen that amplifier 86 has the effect of inverting the signal from integrator 82 and truncating the sawtooth waveform by subtracting the lower half of the signal, as shown in the accompanying signal diagram.

In actuality, the value of diode D3 is preferably selected so that soemwhat more than half of the sawtooth waveform is removed. In other words, the level portion of the waveform provided at the output of amplifier 86 preferably comprises more than 50% of the signal. Although circuitry for varying this percentage in accordance with the production of different phonemes has been experimented with, the increased complexity due to the substantial amount of additional circuitry required negated inclusion of such circuitry in the preferred embodiment of the system. Rather, the fixed waveform utilized has been found to be highly appropriate for most purposes. Practically speaking, few instances exist wherein a change in the cut-off level of the signal will produce a significant difference in the quality of the audio output.

In addition, the output signal from amplifier 86 more closely approximates human glottal characteristics by simulating the three fundamental actions of the human glottis. In particular, the positive going portion of the truncated waveform simulates the opening of the glottis, the declining portion of the waveform simulates the closing of the glottis, and the level portion of the waveform simulates the closed glottis. Significantly, the resulting glottal waveform accounts for the fact that the human glottis closes shortly after maximum excitation occurs to permit the vocal chords to freely resonate in response thereto. Since the truncated glottal waveform produces maximum excitation as the signal reverses its direction at its positive peak, it can be seen that the waveform simulates the "rest" feature of human glottal action by providing an inactive period (corresponding to closed glottis) shortly after that portion of the signal wherein maximum excitation occurs.

The novel glottal waveform disclosed herein is additionally significant in that it is also used in combination with the glottal suppression circuitry to be subsequently described to provide glottal suppression of vocal resonances similar to that which naturally occurs in the human voice.

It is well known that the frequency at which the human glottis vibrates does not remain constant. The variations in the fundamental frequency or "pitch" of the human voice can be divided into two basic categories: voluntary and involuntary. Voluntary changes in pitch can be described as those shifts and patterns that an individual assigns to a message to indicate the importance of a particular word or to convey a certain emotion. Involuntary changes, on the other hand, are caused by the sub-glottal pressure and musculture changes that naturally occur when vowels and consonants are spoken. Note, for example, the "involuntary" change in the fundamental frequency of the voice in the words "beat" and "bat". The fundamental frequency invariably decreases in the word "bat", and increases in the word "beat". This is because the phoneme "e" in the word "beat" requires a more tense muscle condition during articulation than the "ae" phoneme in the word "bat". Since it is often the case that users of a synthesizer do not use the inflection command bits, the speech produced without at least involuntary inflection information included is very unnatural. Furthermore, when a synthesizer is utilized primarily as a printed text-to-audio converter, optimum use o the inflection command bits becomes extremely difficult. In addition, if involuntary inflection assignment is included in the design of a synthesizer, normal inflection programming is simplified since it can be devoted primarily to voluntary fundamental frequency changes.

Figure 3A:
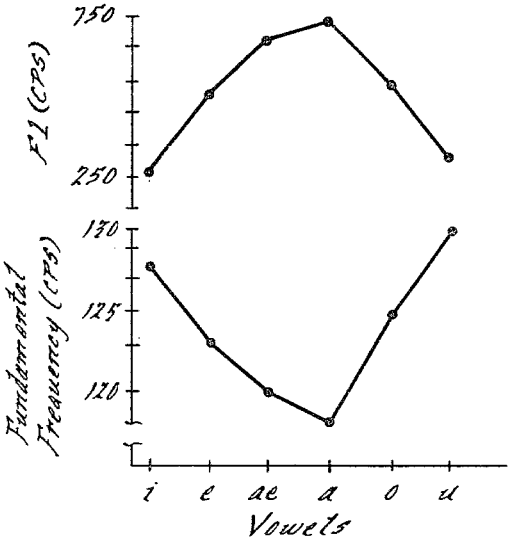
FIG. 3*a* is a graphic illustration of the relationship between the fundamental frequency of the glottal waveform and the movement of the first resonant pole over a range of vowel phonemes.

The present invention incorporates inflection assignment into its design by altering the input signals to integrator 82 in accordance with certain recognized inflection patterns associated with the production of various groups of phonemes. Looking to FIG. 3*a*, the relationship between the fundamental frequency and the location of the first fesonant formant during the production of vowel phonemes is shown. From a review of the graph, it becomes apparent that the fundamental frequency varies inversely with respect to changes in the location of the first formant over the spectrum of vowel phonemes indicated. This relationship is applied to the present invention by connecting the output from the F1 transition filter through a resistor R11 to the positive input of ingtegrator 82. Thus, it can be seen that as the signal from the F1 transition filter increases, the difference between the voltage levels at the positive and negative inputs of integrator 82 decreases. This, in turn, decreases the negative slope of the sawtooth waveform at the output of integrator 82 as determined by the voltage level on capacitor C1. The decrease in the slope of the negative-going portion of the sawtooth waveform has the effect of lengthening the waveform which, of course, decreases the frequency of the signal. Thus, the fundamental frequency of the glottal waveform is automatically varied inversely with resepct to changes in the F1 control signal, which controls the location of the first formant.

Figure 3B:
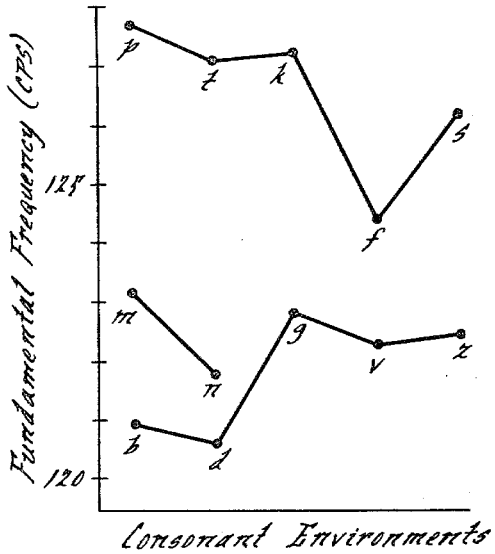
FIG. 3*b* is a graphic illustration of the changes in the fundamental frequency of the glottal waveform over a range of consonant phoneme environments.

Referring to FIG. 3*b*, the position of the mean fundamental frequency in various consonant environments is shown. As illustrated in the graph, during the presence of nasal phonemes, such as "n", "m", or "ng", the mean fundamental frequency typically decreases. This characteristic inflection variation is applied to the present invention by connecting the output from the nasal transition filter through a resistor R10 to the positive input of integrator 82. In this manner, the fundamental frequency of the glottal waveform generated at the output of integrator 82 is made to decrease when a nasal control signal is present. More specifically, the increased potential at the positive input of integrator 82 due to the presence of a signal from the nasal transition filter causes a decrease in the slope of the negative-going portion of the sawtooth waveform in the same manner as that previously described in relation to the inflection modification created by the F1 control signal. Thus, the fundamental frequency of the glottal waveform decreases when nasal phonemes are generated.

Looking again to FIG. 3*b*, it will be noted that in the presence of fricative phonemes, such as "f", "h", "s", or "sh", the fundamental frequency of the glottal waveform tends to increase. To implement this inflection characteristic into the design of the system, the output from the fricative amplitude transition filter is connected through a resistor R9 to the negative input of integrator 82. Since a fricative amplitude control signal is present whenever a fricative phoneme is generated, the potential at the negative input of integrator 82 will increase in the presence of a fricative phoneme. By increasing the relative potential at the negative input of integrator 82, the time constant of the circuit is decreased thereby increasing the slope of the negative-going portion of the sawtooth waveform, which in turn increases the fundamental frequency of the output signal. Thus, the fundamental frequency of the glottal waveform is made to increase during the production of fricative phonemes.

Finally, it can be seen from FIG. 3*b* that in the presence of phonemes such as "b","d", or "g", the mean fundamental frequency decreases. To implement this inflection characteristic, it becomes necessary to select the combination of control signals that uniquely identifies the presence of these phonemes. The phonemes "b", "d", and "g" re "plosive" phonemes that require the production of a closure control signal. However, a closure control signal is also generated for the plosive phonemes "p", "t", and "k". And, as the graph in FIG. 3*b* illustrates, the mean fundamental frequency for the phonemes "p", "t", and "k" is substantially greater than the mean fundamental frequency for the phonemes "b", "d", and "g". Therefore, to distinguish between these two groups of phonemes, it becomes necessary to include another control signal. Specifically, the phonemes "b", "d", "g", are voiced stops, while the phonemes "p", "t", and "k", are unvoiced stops. Thus, by taking the output from the vocal amplitude transition filter and logically "ANDing" it with the output from the closure transition filter, the presence of the phonemes "b", "d", and "g" can be uniquely determined. This inflection modification is implemented by connecting the output from the vocal amplitude transition filter through a pair of series-connected resistors R12 and R13 to the positive terminal of integrator 82, and connecting the output from the closure transition filter through a diode D2 to the midpoint of resistors R12 and R13. With the resistive value of R13 substantially greater than that of R12, the circuit arrangement effectively operates as a logical AND gate, thereby increasing the potential at the positive input of integrator 82 only when an output signal is provided from both the vocal amplitude transition filter and the closure transition filter. Thus, when both control signals are present, the fundamental frequency of the glottal waveform is decreased.

It should be noted that since the inflection modification parameters are taken off the outputs of the transition filters, changes in the inflection level of the audio output occur gradually as in natural human speech. It is to be further understood that the automatic inflection control heretofore described is in addition to and less dramatic than programmed inflection changes. However, if the system is to be primarily used as a printed text-to-audio converter, the automatic inflection variations can be made more obvious by merely altering the resistance values of the circuit.

Figure 5:
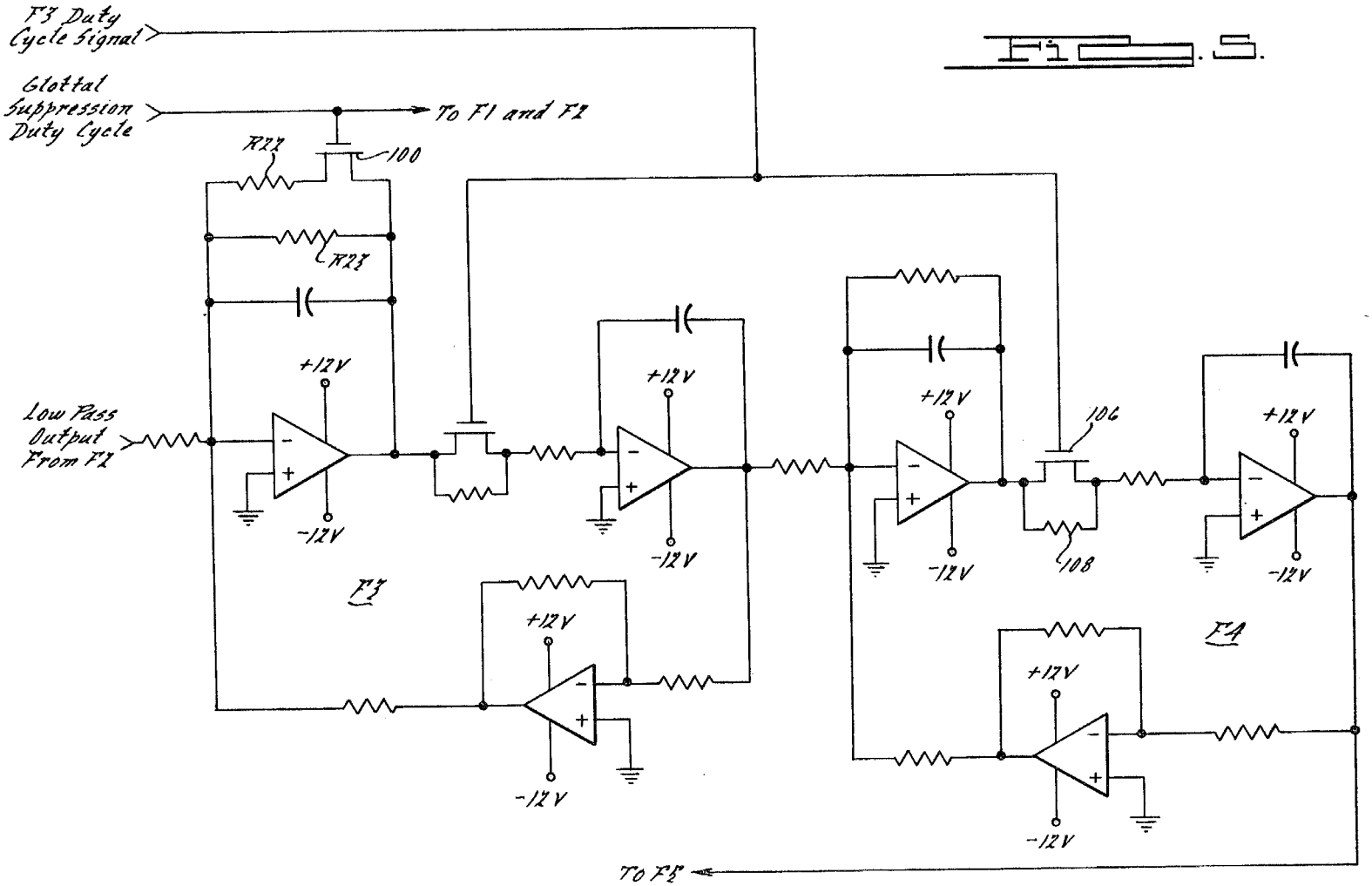
FIG. 5 is a circuit diagram of the third and fourth order resonant filters in the vocal tract of the system illustrated in FIG. 1.

As previously mentioned in the description of the block diagram illustrated in FIG. 1, the present system includes a "high-pole" compensation circuit which increases the spectral energy of the glottal waveform at high frequencies. The reference to a "high-pole" relates to the formants high in the frequency spectrum of the audible range. Although within the audible range, it is generally acknowledged that the higher-pole formants do not contribute to the intelligibility of the audio output. However, their presence has been found to effect the relative spectral energy available at the lower formants which do contribute to speech intelligibility. Accordingly, the present invention incorporates into the system a high-pole compensation circuit which adds a high frequency formant to the glottal waveform at approximately 4000 Hz. This is accomplished by providing the truncated glottal waveform produced at the output of amplifier 86 to a highly damped bi-quad resonator 96. Bi-quad resonator 96 is a fixed-pole filter virtually identical to the resonant filters used in the vocal tract which are shown in detail in FIG. 5, except that the output from bi-quad resonator 96 is taken off the bandpass output terminal rather than from the low pass output as in the vocal tract. The output from the bi-quad resonator 96 is provided to a summing junction 94 through a summing resistor R21. The truncated glottal waveform is also provided to the summing junction 94 through a summing resistor R20. Thus, the signal appearing at the summing junction includes the truncated glottal waveform with the addition of a formant at approximately 4,000 Hz, which effectively increases the spectral energy of the waveform at high frequencies.

It will benoted that the location of the formant added to the glottal waveform is lower in frequency than the highest resonant formant in the vocal tract. It has been found that this relationship is particularly important to improving the quality of the speech generated, and produces better results than if the formant added to the glottal waveform was the highest formant in the speech system.

Figure 4:
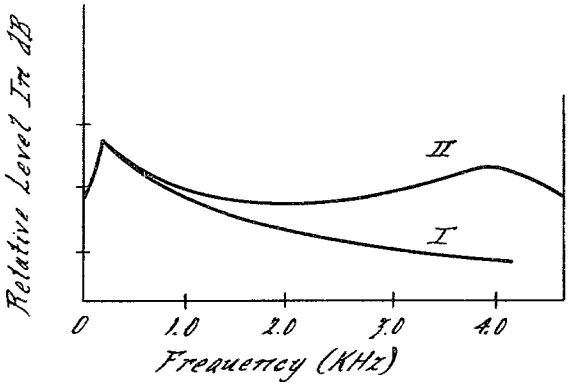
FIG. 4 is a graphic illustration comparing the spectral energy of the glottal waveform before and after the addition of high-pole compensation.

Referring to FIG. 4, the effect of the bi-quad resonator 96 on the spectral energy of the glottal waveform is graphically illustrated. The curve identified with a "1" represents the spectral energy of the glottal waveform without the bi-quad resonator, and the cruve identified by a "11" represents the spectral energy of the glottal waveform with the addition of the bi-quad resonator. From the diagram, it can be seen that without the high-pole compensation, the spectral energy of the glottal waveform decays substantially at the higher frequencies. However, with the addition of the high-pole compensation, the spectral energy of the glottal waveform is maintained at a high level beyond 4 KHz, which corresponds to the resonant frequency of the bi-quad resonator.

It should be noted, that high-pole compensation is particularly important in speech synthesizers of the type described in FIG. 1 wherein the vocal tract employs cascaded or serially connected resonant filters. This is due to the inherent energy loss which occurs in the excitation signal as it passes through the lower frequency-pole resonators in the vocal tract.

Returning to FIG. 2, before the vocal excitation signal is provided to the vocal excitation controller, the signal is passed through a high pass filter 98 which filters frequencies below approximately 150 Hz. The purpose of the high pass filter 98 is to remove the energy from the glottal waveform at the low frequency end of the spectrum. This, in effect, removes the "bassiness" in the signal, leaving the "sharper" high frequency portions of the glottal waveform in tact, thereby improving speech intelligibility.

As will be recalled from the discussion of FIG. 1, the present system includes a glottal suppression circuit that simulates the reduced impedance that is reflected in the human vocal tract when the glottis is opened. The purpose of the glottal suppression circuit can be more specifically explained as follows. The human vocal tract is open at one end, the mouth, but closed at the other end, the glottis, only part of the time. When the glottis is open, this has the effect of reducing the impedance in the vocal tract which, in turn, results in a dampening of the formant resonances. It is this characteristic of the human vocal tract that the glottal suppression circuit is intended to simulate. Referring again to FIG. 2, the vocal excitation signal from amplifier 86 is provided through an analog gate 88 and a voltage divider network, consisting of resistors R18 and R19, to the positive input of a comparator amplifier 92. The negative input of the comparator amplifier 92 is connected to the 20 KHz triangular clock signal. Comparator amplifier 92 is adapted to provide a signal at its output whenever the magnitude of the signal applied to its positive input exceeds the magnitude of the signal applied to its negative input. Thus, it can be seen that comparator amplifier 92 will produce a 20 KHz variable pulse width output signal whose percentage duty cycle is directly proportional to the potential of the glottal waveform applied to its positive input. Since the frequency of the clock signal applied to the negative input of comparator amplifier 92 is on the order of 200 times greater than the frequency of the glottal waveform applied to the positive input, it will be appreciated that the output signal from comparator amplifier 92 will appear as a rapid succession of spikes that get progressively wider as the glottal waveform increases in magnitude. As the glottal waveform approaches its maximum amplitude, the output signal from comparator amplifier 92 will appear substantially as a constant level signal interposed with a rapid succession of progressively narrower negative-going spikes. Furthermore, it will be appreciated that no pulses will appear at the output of comparator amplifier 92 during that portion of the glottal waveform representing the closed glottis, i.e. during the level portion of the waveform.

The glottal suppression duty cycle signal produced at the output of comparator 92 is applied to the vocal tract filter unit 60. Looking to FIG. 5, the F3 and F4 bi-quad resonant filters from the vocal tract unit are shown in detail. As the diagram indicates, the glottal suppression duty cycle signal is applied to the enabling terminal of an analog gate 100 which is connected in series with a resistor R22. The series combination is connected across the "Q" or bandpass resistor R23 of the F3 bi-quad resonator. In operation, when the analog gate 100 is open—i.e. when the glottal suppression duty cycle signal is equal to zero—resistor R22 appears as an infinite resistance, thus having no effect on the Q of resonant filter F3. As the duty cycle of the glottal suppression signal increases, the analog gate 100 begins conducting, thereby reducing the effective resistance of resistor R22, which decreases the Q of the resonator. As the glottal suppression signal approaches maximum duty cycle, resistor R22 approaches its rated value, thereby decreasing the Q of resonant filter F3 to its minimum value. The effect, therefore, is to dampen resonance due to open glottis, with maximum dampening occurring when the glottal waveform reaches its positive peak, which corresponds to maximum open glottis.

It is to be understood, that the glottal suppression duty cycle signal is also applied to a similar pair of analog gates connected across the bandpass sections of bi-quad resonators F1 and F2 in the same manner as that described in connection with resonator F3. Thus, it will be appreciated that the Q of all three bi-quad resonators F1, F2, and F3, is made to vary during the glottal period in accordance with those portions of the glottal waveform simulating the opening and closing of the human glottis.

However, contrary to the operation of the vocal excitation source in the present speech synthesizer, the analogous component in the human speech system, the glottis, is not active 100% of the time. Specifically, during the generation of unvoiced phonemes, the glottis is not active at all. Therefore, it can be seen that it is desirable to include the effect of glottal suppression only during the production of voiced phonemes. Returning to FIG. 2, this is accomplished by providing the output from the vocal amplitude transition filter to the positive input of a comparator amplifier 90. The negative input to the comparator amplifier 90 is connected to the midpoint of a voltage divider network comprised of a pair of resistors R16 and R17 connected in series between a +8 volts bias supply and ground potential. The output from comparator amplifier 90 is connected to the enabling terminal of the analog gate 88, which functions as an electronic switch. The comparator amplifier 90 is adapted to provide an enabling signal to analog gate 88 only when a signal is present from the vocal amplitude transition filter. Since the presence of a vocal amplitude control signal indicates the presence of a voiced phoneme, it will be appreciated that analog gate 88 is conductive, and therefore a glottal suppression duty cycle signal is gnerated, only during the production of voiced phonemes. Accordingly, during the production of unvoiced phonemes analog gate 88 is non-conductive, thus preventing the production of a glottal suppression duty cycle signal.

Returning to FIG. 5, it will be noted that in addition to having resonant filters F1, F2, and F3 variable, Fe has also been made variable to improve the naturalness of the voice created. Prior art voice synthesizers typically include four or five resonant filters. However only the first three, F1, F2, and F3, are usually made variable. Although it has been recognized that adding movement to the fourth resonant filter would be desirable, it is usually not done because of the increased complexity involved in generating additional data or parameters; it being considered sufficient to make only the first three resonant filters variable. However, it has been found that the movement of the fourth resonant pole to a degree tracts with the movement of the third resonant pole. Given this relationship, the present invention adds movement to the fourth resonant filter simply by adding analog gate 106 and resistor 103 to bi-quad resonator F4 and providing the F3 duty cycle signal that controls the location of the frequency pole in the F3 resonant filter to the enabling terminal of analog gate 106. Thus, it can be seen that the F4 resonant filter is made variable without requiring the generation of additional data or parameters simply by using the same variable control signal that drives the F3 resonant filter.

Figure 6:
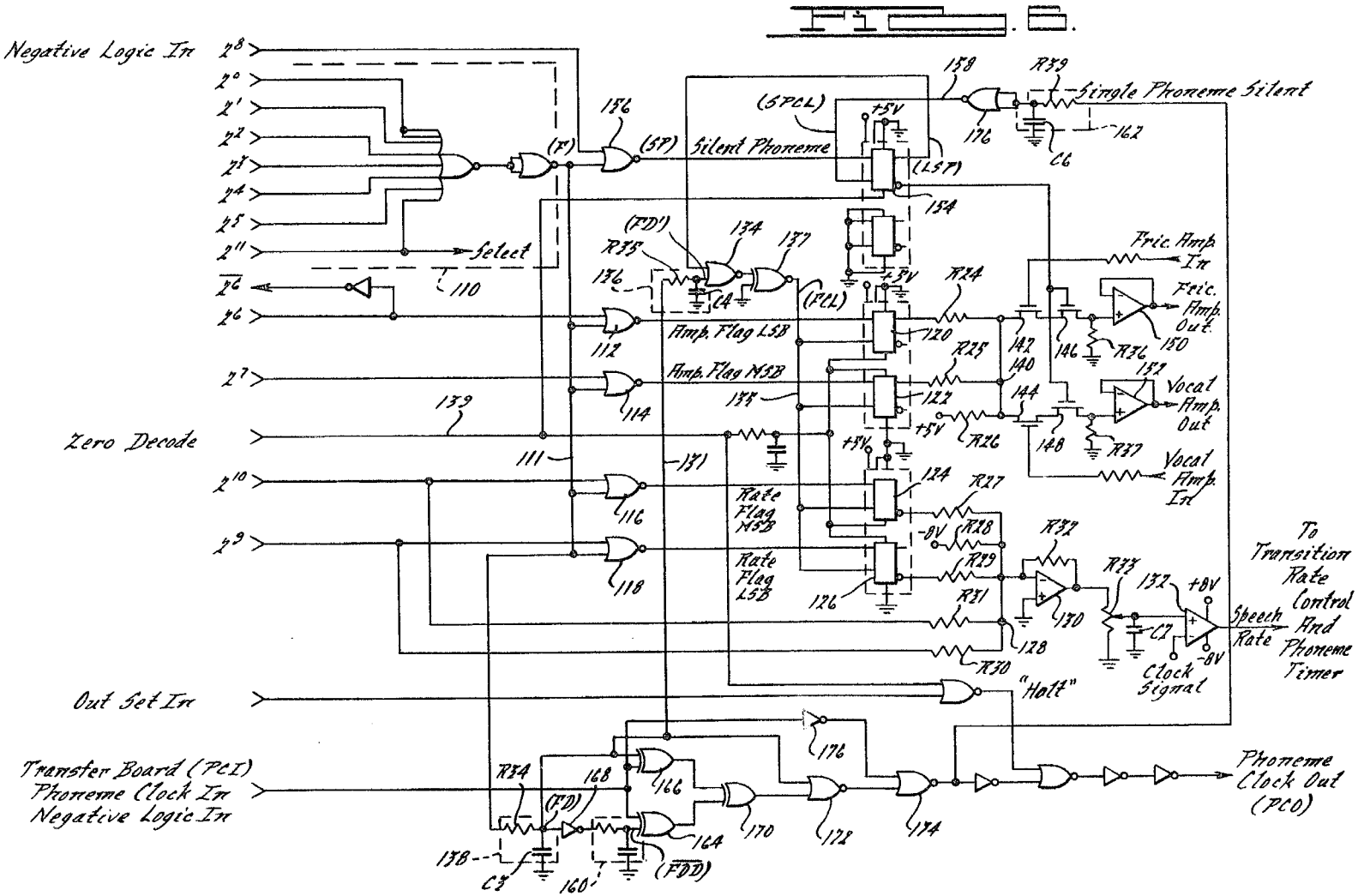
FIG. 6 is a circuit diagram of the flag command decode and control circuit of the system illustrated in FIG. 1.

Looking now to FIG. 6, a circuit diagram of the flag command decode and control unit 50 is shown. Also included in the circuit diagram of FIG. 6 are the rate control phoneme rate summer, and vocal amplitude and fricative amplitude modulation circuits.

As will be recalled from the discussion of FIG. 1, each phoneme has associated therewith a preselected time period as determined by the phoneme timing control signal that establishes the normal period during which the phoneme will be produced. If it is desired to programmably vary the time period of a given phoneme, the present system provides two rate select bits which offer the programmer the option of four different time periods for each given phoneme. If the rate select bits are not used, each phoneme will be produced for its normal time period. However, if the programmer desires to either increase or decrease the duration of a given pheneme, the appropriate change is entered via the two rate select bits. Additionally, in text-to-audio conversion applications the same phoneme can be given greater or less stress under program control simply by changing the rate select bits.

The present invention provides programmable rate control by connecting the two rate bits, $2^9$ and $2^{10}$, to a summing junction 128 through a pair of weighting resistors R30 and R31, respectively. Resistor R30 is selected to have twice the resistive value of resistor R31, thus making the $2^9$ bit the less significant bit and the $2^{10}$ bit the more significant bit. The summing junction 128 is also connected to a −8 volts bias potential through resistor R28. The output from the summing junction 128 is connected to the negative input of a summing amplifier 130. The positive input of summing amplifier 130 is tied to ground and its output is returned through feedback resistor R32 to its negative input. Summing amplifier 130 effectively acts as a current-to-voltage converter by providing an analog output signal whose magnitude is proportional to the current level at summing junction 128. When both of the rate select bits are set to a logical 0, the −8 volts bias potential applied through resistor R28 establishes the minimum current level at summing junction 128 which, in turn, determines the minimum voltage level at the output of summing amplifier 130. In the preferred embodiment, the circuit values are selected so that this voltage equals approximately 2.3 volts. The output from summing amplifier 130 is connected to the top of the rate potentiometer R33 which has its other end tied to ground. The wiper of potentiometer R33 is connected to the positive input of a comparator amplifier 132 and through a capacitor C2 to ground. The negative input of the comparator amplifier 132 is connected to the 20 KHz triangle clock signal. The comparator amplifier 132 produces a 20 KHz variable pulse width output signal whose duty cycle is determined by the magnitude of the signal applied to its positive input. The potential of the signal applied to the positive input of comparator amplifier 132 can be varied either by manually adjusting the setting of potentiometer R33 or by varing the current level at summing junction 128 which alters the voltage level at the top of rate potentiometer R33. Thus, it will be appreciated that the logical states of the two rate select bits effect the current level at summing junction 128 which, in turn, effects the duty cycle of the speech rate signal produced at the output of comparator amplifier 132. In the preferred embodiment, the rate select bits are normally set to a logical "01" state to permit two levels of "increase" and a single level of "decrease" in the duty cycle of the speech rate signal. As will be recalled from FIG. 1, the speech rate duty cycle signal from comparator amplifier 132 is provided to the phoneme timer circuit where it is combined with the phoneme timing control signal to determine the slope of the timing ramp generated by the phoneme timer. Thus, it can be seen that the two rate select bits provide means for programmably varying the timing of individual phonemes.

In addition, the present invention includes a flag command decode and control circuit which provides the present system with the capability of programmably varying the overall volume and speech rate of the audio output. The preferred embodiment of the flag circuit shown in FIG. 6 is designed to accept the inverted logic of the input command word. Therefore, as a general note to the description of the circuit, it is to be understood that the presence of a signal is indicated by a logical "0", and the absence of a signal is indicated by a logical "1".

As the circuit diagram in FIG. 6 illustrates, the flag control circuit receives all twelve input bits from the data command word. The flag control circuit is assigned a unique seven bit "name" which is entered on the seven phoneme select input lines to "call" the flag control circuit. The seven phoneme select bits are provided to a logic circuit 110 which decodes the information contained on the seven phoneme select input lines to determine when the flag control circuit is called. In the preferred embodiment illustrated, the flag control circuit is assigned the name "0000000". Thus, logic circuit 110 acts effectively as a seven input OR gate, providing a LO output signal only when all seven of the phoneme select bits are set to a logical zero.

When the flag control circuit is called, two of the inflection select bits, $2^6$ and $2^7$ are employed as amplitude select bits, and the two rate select bits are used to vary the overall speech rate of the audio output. In addition, the third inflection select bit $2^8$ is employed as a silent phoneme bit whose function will subsequently be explained in greater detail. Each of the four amplitude and rate bits are connected to one of four logical NOR gates 112, 114, 116, and 118. When logic circuit 110 provides a LO output signal on line 111, indicating that the flag circuit has been called, NOR gates 112, 114, 116, and 118 are enabled. In other words, when the flag control circuit is called, the outputs from NOR gates 112, 114, 116 and 118 will reflect the inverted logic states of the amplitude and rate select bits. The outputs from the four NOR gates 112, 114, 116, and 118 are each provided to the data input (D) of a J-K flip-flop 120, 122, 124, and 126 respectively.

Flip-flops 120, 122, 124 and 126 are clocked by the flag clock signal which is received on line 135 from the output of an exclusive NOR gate 137. One of the inputs to exclusive NOR gate 137 is tied to ground and its other input is connected to the output of NOR gate 134. NOR gate 134 has one of its inputs connected to the output of a time delay network 136 comprised of resistor R35 and capacitor C4, and its other input connected to the Q output terminal of J-K flip-flop 154. Time delay network 136 receives a delayed flag signal on line 131 from another time delay network 138, comprised of resistor R34 and capacitor C3, which receives the actual flag signal from the output of logic circuit 110 on line 111.

Assuming for now that the Q output from flip-flop 154 is set to a logical O, it can be seen that when the signal on line 131 goes LO, the output from NOR gate 134 will go III, causing the output from exclusive NOR gate 137 to also go III, which clocks flip-flops 120, 122, 124 and 126 and enters the data present at the data input terminals of the flip-flops. It is to be understood that the time delay circuit 138 is included to insure that the data from the amplitude and rate select bits arrive at the inputs to flip-flops 120, 122, 124 and 126 before the flag clock signal on line 135. Thus, it can be seen that when the flag circuit is called, the data (inverted) from the amplitude and rate select bits is transferred to the Q output terminals of the four J-K flip-flops 120, 122, 124 and 126.

The two speech rate control flip-flops, 124 and 126, have their Q output terminals connected through a pair of weighting resistors, R27 and R29 respectively, to the summing junction 128. Accordingly, it can be seen that the logic states of the Q output terminals of flip-flops 124 and 126 also effect the current level at the summing junction 128, which as previously discussed, determines the voltage level at the top of the rate potentiometer R33.

Weighting resistor R27 is preferably selected to have a resistance of approximately one half of the value of resistor R29. Thus, the logic state of flip-flop 124 has a greater effect on the current level at summing junction 128 than the logic state of flip-flop 126. In addition, it will be noted that the zero decode signal on line 139 is connected to the reset terminal (R) of flip-flop 124 and to the set terminal (S) of flip-flop 126. The zero decode line presets the J-K flip-flops to their "normal" logic states. Accordingly, the logic state of the Q output of flip-flop 124 is normally set to "0", and the logic state of the Q output of flip-flop 126 is normally set to "1". Thus, from the normal setting, there is available two levels of "increase" and a single level of "decrease" in the overall speech rate of the audio output.

It will further be noted that in the preferred form of the present invention, the value of resistor R29 (which is greater than R27) is less than the value of resistor R31 (which is one half the value of resistor R30). In this manner, the overall changes in the speech rate of the audio output caused by variations in the logic states of flip-flops 124 and 126 when the flag circuit is called are more pronounced than the fluctuations in the relative time periods of individual phonemes created by changes in the logic states of the rate select bits $2^9$ and $2^{10}$ as applied through resistors R30 and R31 respectively.

It is also to be noted that since the logic states of flip-flops 124 and 126 remain constant until a new clock pulse is received at their clock terminals (CL), it can be seen that a programmed change in the overall speech rate of the system will remain after the duration of the flag phoneme. More specifically, changes in the logic states of flip-flops 124 and 126 are fixed, notwithstanding subsequent adjustments in the two rate select bits, until the flag phoneme command is again encountered. Thus, it will be appreciated that the present system offers the capability of programmably adjusting the timing of individual phonemes via the rate select bits, or programmably changing the over-all speech rate of the audio output via the flag command control circuit in combination with the two rate select bits.

Looking now to the amplitude control section of the circuit shown in FIG. 6, the Q output terminals of the volume control flip-flops 120 and 122 are connected through a pair of weighting resistors, R24 and R25 respectively, to a summing junction 140. The summing junction 140 is also tied to a +5 volts bias potential through resistor R26. Accordingly it will be understood that the logical states of flip-flops 120 and 122, together with the contribution from the +5 volts bias potential, control the current level at summing junction 140. The +5 volts bias potential as applied through resistor R26 establishes the minimum current level at summing junction 140 when the Q outputs from flip-flops 120 and 122 are both set to a logical "0". The output from summing junction 140 is provided to a pair of analog gates 142 and 144. The enabling terminals of analog gates 142 and 144 are connected to receive the fricative amplitude and vocal amplitude control signals, respectively, from ROM 14. The other sides of analog gates 142 and 144 are each connected to the positive input of an operational amplifier, 150 and 152, respectively, through another pair of analog gates, 146 and 148, respectively, whose function will be explained later.

Amplifiers 150 and 152 are each connected in a voltage follower arrangement with their positive inputs tied to ground through resistors R36 and R37, respectively, and their outputs returned to their negative inputs. In this manner, amplifiers 150 and 152 provide a low impedance drive to the closure delay and vocal delay circuits to which the output signals from amplifiers 150 and 152, respectively, are applied.

The magnitude of the fricative amplitude and vocal amplitude control signals is modulated in the following manner. With additional reference to FIG. 7, the summing junction 140 provides a constant potential signal to analog gates 142 and 144, whose magnitude, for example 3 volts, is determined by the logic states of flip-flops 120 and 122. It is to be understood that if analog gates 142 and 144 were continuously enabled by the fricative amplitude and vocal amplitude control signals, respectively, analog gates 142 and 144 would appear as simple conductors. As such, the constant potential signal from summing junction 140 would simply be transmitted to the positive inputs of amplifiers 150 and 152 unaltered. However, it will be recalled that the fricative amplitude and vocal amplitude control signals from ROM 14 comprise time weighted variable pulse width square wave signals that vary in magnitude between 0 to 5 volts. Thus, it will be appreciated that when the amplitude control signals from ROM 14 are "III", the analog gates 142 and 144 will conduct the signal from summing junction 140. Conversely, when the amplitude control signals from ROM 14 are "LO", the analog gates 142 and 144 will act as open switches and prevent transmission of the signal from summing junction 140.

Figure 7:
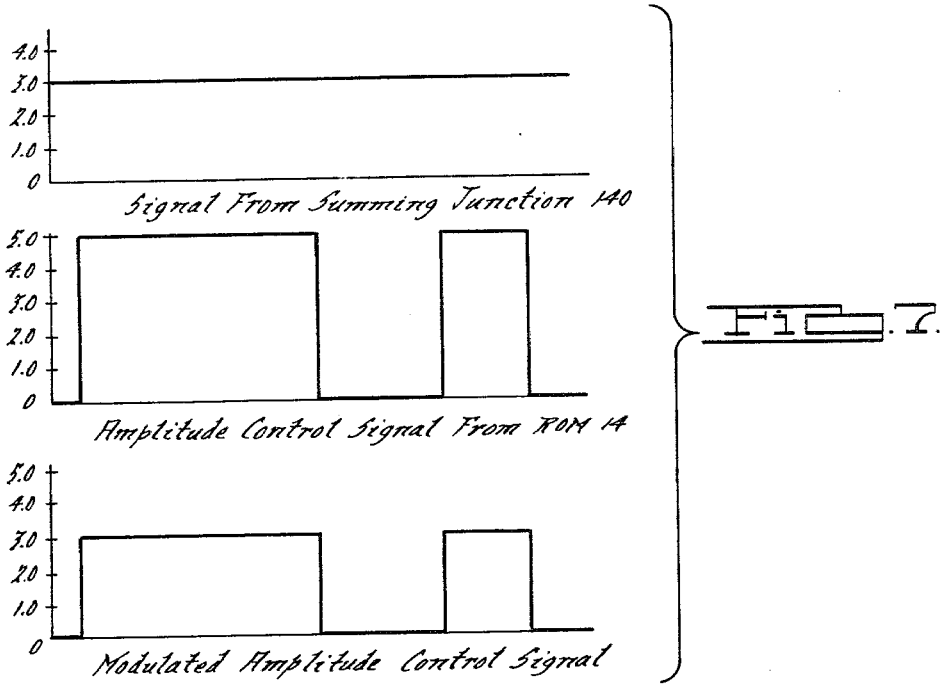
FIG. 7 is a signal diagram illustrating the modulation of the amplitude control signals as produced by the flag command decode and control circuit of FIG. 6.

Thus, as shown in FIG. 7, the output signals from analog gates 142 and 144 comprise variable pulse width square wave signals whose duty cycle is equivalent to the duty cycle of the fricative amplitude and vocal amplitude control signals, respectively, but whose voltage swing is limited to the magnitude of the signal from summing junction 140. In other words, the output signals produced by analog gates 142 and 144 are equivalent to the fricative amplitude and vocal amplitude control signals respectively, except that the amplitude of the signals has been modulated to correspond to the voltage potential at summing junction 140. Thus, since the value of the amplitude control signals is determined by their average amplitudes over a 15 clock pulse period, it can be seen that the volume of the audio output is accordingly changed. In addition, since the logic states of flip-flops 120 and 122 remain constant until another flag clock signal is received on line 135, the overall change in the volume of the audio output will persist until a subsequent flag command is encountered, irrespective of changes in the two inflection select bits $2^6$ and $2^7$.

It will also be noted that the zero decode line 139 which establishes the normal amplitude setting, is connected to the reset terminal of flip-flop 120 and the set terminal of flip-flop 122. Since flip-flop 120 supplies the less significant bit and flip-flop 122, the more significant bit, the normal amplitude setting preferably permits two levels of decrease and a single level of increase.

As previously mentioned, the flag command and control circuit also provides the system with the capability of introducing an articulated silent phoneme into the speech pattern. Looking at the circuit diagram in FIG. 6, the output from logic circuit 110 is additionally provided to one of the inputs of a dual input NOR gate 156. The silent phoneme bit $2^8$ is connected to the other input to NOR gate 156, and the output from NOR gate 156 is applied to the data input terminal of J-K flip-flop 154. Accordingly, it can be seen that when the flag control circuit is called, as indicated by a LO output signal from logic circuit 110, and the silent phoneme bit $2^8$ is set to a logical 0, the output from NOR gate 156 will go HI. The $\overline{Q}$ output terminal of flip-flop 154 is connected to the enabling terminals of analog gates 146 and 148. With the zero decode line 139 connected to the reset terminal of flip-flop 154, the $\overline{Q}$ output of flip-flop 154 is normally HI. Therefore, analog gates 146 and 148 are normally conducting. Thus, it will be understood that in the absence of a silent phoneme, the fricative amplitude and vocal amplitude control signals are conducted by analog gates 146 and 148 respectively. However, in the presence of a silent phoneme, a HI signal is provided to the data terminal of flip-flop 154, which causes the logic state of $\overline{Q}$ to go LO when the appropriate silent phoneme clock signal on line 158 is provided to the clock terminal of flip-flop 154. When this occurs, analog gates 146 and 148 are rendered nonconductive, thus preventing the transmission of both the fricative amplitude and vocal amplitude control signals. In the absence of both amplitude control signals, neither the voiced nor unvoiced excitation signal quantities are injected into the vocal tract.

However, as will subsequently be explained in greater detail, although the duration of the flag command phoneme is extremely brief, the duration of the silent phoneme is equivalent to the period of a normal voiced phoneme. Consequently, the articulation pattern for any phoneme can be generated during the silent phoneme period following the flag command. The primary advantage of this novel feature is as follows.

Although theoretically any desired speed sound should be capable of being produced by the proper phoneme combination, in actuality, there are certain speech sounds which simply cannot accurately be produced utilizing phonemes alone. For example, words with vowelized beginnings, as well as words beginning with the letters "l" or "w", are words in which the articulation patterns are formed before actual voicing of the words begins. In particular, notice how the mouth prepares to annunciate the words "oak", "ear" "like", and "walk" before the words are actually spoken. Without this preparation, these words begin too abruptly and sound unnatural, as if the first phoneme in each word were partially dropped.

The silent phoneme feature of the present system can be used to simulate this articulation characteristic of human speech by providing the means for setting the articulation pattern for a particular phoneme before the phoneme is actually generated. For example, if a word beginning with the letter "w" is to be produced, the preferred sequence of input command words would call for a silent flag phoneme followed by two "w" phonemes. In this manner, although the first "w" phoneme following the flag command is not vocalized, the articulation pattern for the "w" phoneme is still formed during the silent phoneme period. Accordingly, with its articulation pattern set in advance as in human speech, the vocalization of the sound "w" phoneme is markedly smoother and natural sounding.

In addition, the silent phoneme feature can also be used to improve the speech recognition of certain sounds that appear at the end of words. In particular, words whose endings tend to "trail off", such as those ending in nasal phonemes, sound as if an additional phoneme has been included when the articulation pattern of the last phoneme is abruptly terminated. For example, if the "n" phoneme in the word "sun" is abruptly terminated, the word sounds more like "suna". This is primarily due to the fact that the residual energy in the vocal tract is vocalized as something other than an "n" after the duration of the "n" phoneme period.

To prevent this from occuring, the silent flag command can be used in combination with an additional "n" phoneme to add a "silent n" to the end of the word. In this manner, the articulation pattern of the "n" phoneme is maintained, causing the nasal "n" sound to fade more naturally.

Figure 8:
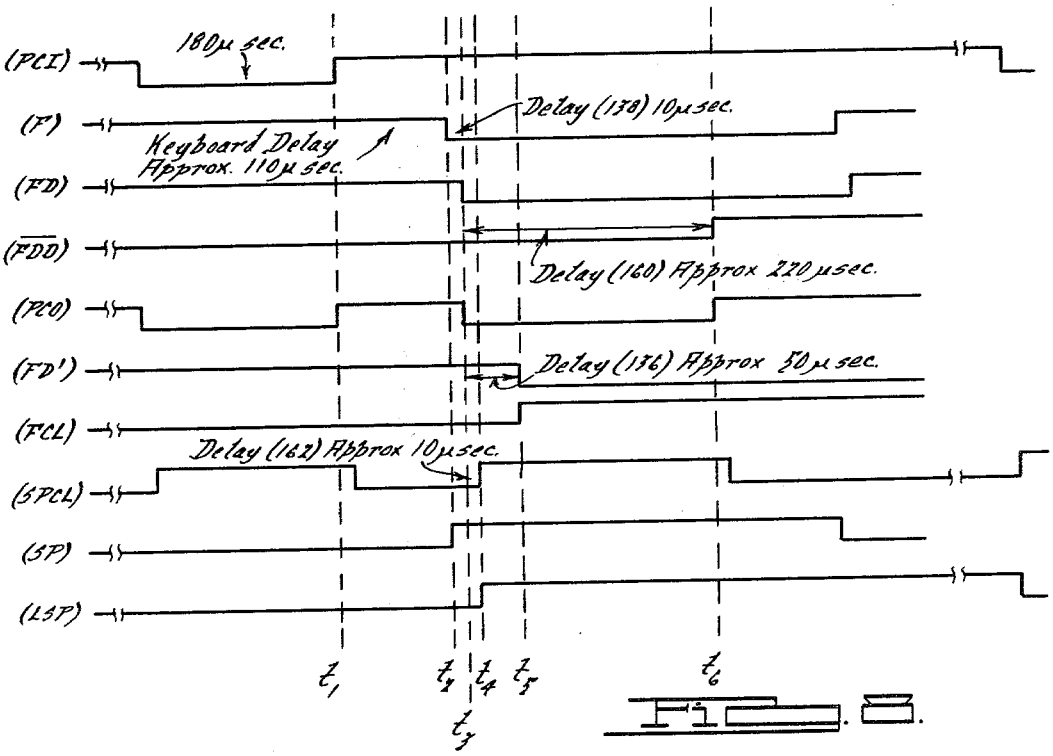
FIG. 8 is a signal diagram illustrating the timing of the various clock signals in the flag command decode and control circuit of FIG. 6.

As previously alluded to, the relative timing of the various clock and data signals in the flag circuit is important to its proper operation, and therefore, will be explained in detail. Referring additionally to FIG. 8, a signal diagram illustrating the conditions of various signals at selected points in the flag circuit is shown. At the outset, it is to be understood that when the flag phoneme is called to vary the overall speed rate and/or volume of the audio output, it is desirable to rapidly proceed to the next phoneme without committing an entire phoneme time period to the flag command. This is because the flag circuit does not require the relatively long amount of time allocated to the production of a typical phoneme to execute the instructed changes. Thus, to avoid the inclusion of a pause into the speech pattern whenever the overall rate and/or volume of the audio output is changed, the flag circuit is adapted to produce another phoneme clock signal in rapid succession to the clock signal that called the flag phoneme.

Looking to FIG. 6, the phoneme clock signal that controls the timing of the input command words (PCI) is provided to a pair of exclusive OR gates 164 and 166. The other input of exclusive OR gate 166 is connected to the output from time delay 138 which provides the delayed flag signal (FD) on line 131. The other input of exclusive OR gate 164 is also connected to the output from time delay 138 through an inverter 168 and another time delay network 160. The signal present at the output of the second time delay network 160 is identified by the notation ($\overline{FDD}$).

The outputs from exclusive OR gates 164 and 166 are provided to another exclusive OR gate 170 which has its output connected to one of the inputs of a dual-input NOR gate 172. The other input to NOR gate 172 is connected to the output of time delay network 138. The output from NOR gate 172 is applied to another dual-input NOR gate 174 which has its other input connected to the (PCI) line through an inverter 176. For purposes of this explanation, the output signal from NOR gate 174 can be considered equivalent to the phoneme clock out signal (PCO).

Assuming that a flag phoneme command is not present, as indicated by a HI output signal (F) from logic circuit 110, it can be seen that the phoneme clock signal is unaltered by the timing circuit. In other words, the phoneme clock out signal (PCO) is equivalent to the phoneme clock in signal (PCI). Under this condition, normal clocking of the input command words takes place.

However, in the presence of a flag phoneme, the output from logic circuit 110 goes LO. When this occurs, the timing circuit adds a second phoneme clock pulse into the phoneme clock signal.

Referring to the signal diagram in FIG. 8, this is accomplished as follows. Since we are dealing here with inverted logic, the phoneme clock pulse on the (PCI) line appears as a negative pulse approximately 180 μsec in duration. The positive-going edge of the clock signal, as indicated at time t1 in the timing diagram, corresponds to the point in time when the flag phoneme command is initially called. After a delay of approximately 110 μsec, at time t2, the logic circuit 110 responds to the phoneme command by providing a LO signal at its output (F). This 110 μsec delay is due primarily to the inherent delay in the keyboard or other similar device which provides the digital input command words. Approximately 10 μsec after time t2, equivalent to the delay introduced by time delay network 138, the delayed flag signal (FD) at the output of network 138 goes LO, causing the phoneme clock out signal (PCO) to also go LO, as indicated at time t3. After an additional period of approximately 220 μsec, equivalent to the delay introduced by time delay network 160, the twice delayed and inverted flag signal ($\overline{FDD}$) at the output of network 160 goes LO, causing the phoneme clock out signal (PCO) to again go HI. Thus, it can be seen that another positive-going edge is added to the phoneme clock signal at time t6 which is effective to call the next phoneme command word approximately 340 μsec after the flag phoneme command is called.

However, to insure that the programmed changes in the overall rate and/or volume of the audio output are executed, it is important that the flag clock signal (FCL) on line 135 is produced before time t6. In other words, the four rate and volume flip-flops 120, 122, 124 and 126 must be clocked during the 220 μsec time delay introduced by time delay network 160.

Returning to time t3, the delayed flag signal (FD) on line 131 is provided to another time delay network 136 which further delays the flag signal by approximately 50 μsec. When this twice delayed flag signal, indicated by the notation (FD), goes LO at time t5, (assuming the absence of a silent phoneme) the flag clock signal (FCL) on line 135 goes HI which enters the information present at the data terminals of flip-flops 120, 122, 124 and 126.

Turning now to the situation wherein the flag circuit is called for the purpose of inserting a silent phoneme into the speech output, it is to be understood that the duration of the silent phoneme in this situation is desired to coincide with the time period of a typical phoneme. Furthermore, in the preferred form of the present invention, the flag circuit is adapted to maintain the status of the rate and amplitude flip-flops 120, 122, 124 and 126 when a silent phoneme is generated so that the conditions that existed before the production of the silent phoneme will continue after the production of the silent phoneme.

Returning to FIG. 6, the output from NOR gate 174 is provided to another time delay network 162 comprised of resistor R39 and capacitor C6. The output from network 162 is tied to both inputs of a dual-input NOR gate 176, and the output from NOR gate 176 is connected to the clock terminal (CL) of silent phoneme flip-flop 154. Thus, as the timing diagram in FIG. 8 illustrates, the silent phoneme clock signal (SPCL) on line 158 is equivalent to the phoneme clock out signal (PCO) inverted and delayed by the time delay introduced by network 162, approximately 10 μsec.

Since flip-flop 154 is latched by the positive-going edge of a signal pulse received at its clock input (CL), it can be seen that when the silent phoneme clock signal (SPCL) first clocks flip-flop 154 prior to time t1, the silent phoneme signal (SP) from input bit $2^8$, has not yet arrived at the data input terminal of flip-flop 154. Therefore, despite the enabling clock signal on line 158, the $\overline{Q}$ output from flip-flop 154 remains HI, hus momentarily maintaining the conductivity of analog gates 146 and 148. As the timing diagram indicates, the presence of a silent phoneme (SP) is not recognized at the data input terminal of flip-flop 154 until time t2 when the output from logic circuit 110 (F) goes LO. Approximately 10 μsec later, at time t3, the phoneme clock signal from NOR gate 174 again goes LO which, after the additional 10 μsec delay introduced by network 162, causes the silent phoneme clock signal (SPCL) on line 158 to again clock flip-flop 154. Thus, at time t4, approximately 300 μsec after the first positive-going pulse on line 158, the silent phoneme signal (SP) from bit $2^8$ is entered into flip-flop 154. This drives the $\overline{Q}$ output from flip-flop 154 LO which renders analog gates 146 and 148 non-conductive.

The additional 10 μsec delay introduced by network 162 is a precautionary measure to insure that the silent phoneme signal (SP) arrives at the data input of flip-flop 154 before the second positive-going pulse on line 158. In addition, since the silent phoneme signal (SP) is not entered until the second positive-going edge in the silent phoneme clock signal (SPCL), it will be appreciated that another positive-going pulse will not be encountered until the succeeding phoneme clock pulse is generated to enter the next phoneme command word. Thus, the $\overline{Q}$ output signal from flip-flop 154 will remain LO for the duration of the phoneme time period.

Finally, to prevent the logic states of flip-flops 120, 122, 124 and 126 from changing when a silent phoneme is present, the Q output signal (LSP) from flip-flop 154 is provided to one of the inputs to NOR gate 134. When the Q output signal (LSP) from flip-flop 154 goes HI at time t4, the output from NOR gate 134 is driven LO, regardless of the status of the signal (FD') at its other input. This, in turn, holds the flag clock signal (FCL) on line 135 LO, preventing the latching of flip-flops 120, 122, 124 and 126. Thus, it is imperative that the time delay introduced by network 136 is sufficient to insure that the Q output signal (LSP) from flip-flop 154 goes HI (at t4) before the (FD') signal goes LO (at t5). In the preferred embodiment, t4 is approximately 40 μsec before t5, therefore, it can be seen that the overall speech rate and volume parameters of the audio output are fixed during the presence of a silent phoneme.

While the above description constitutes the preferred embodiments of the invention, it will be appreciated that the invention is susceptible to modification, variation and change without departing from the proper scope or fair meaning of the accompanying claims.

Having thus described my invention, what is claimed is:

1. In an electronic device for phonetically synthesizing human speech including input means responsive to preselected input data identifying a desired sequence of phonemes for producing control signals representing the parameters defining said phonemes, timing means responsive to one of said control signals for producing a timing signal that determines the duration of production of each of said phonemes, and vocal tract means responsive to said control signals for producing an audio output comprised of said desired sequence of phonemes; the improvement comprising:

programmable rate control means responsive to certain of said input data for selectably varying the speech rate of said audio output by producing a speech rate signal in accordance with certain of said input data that is provided to said timing means to vary said timing signal.

2. The speech synthesizer of claim 1 further including variable rate transition means connected between said input means and said vocal tract means for producing gradual transistions in the values of said control signals as said control signals change from phoneme to phoneme; and wherein said speech rate signal is further provided to said variable rate transition means for varying the rate at which the values of said control signals are transitioned.

3. The speech synthesizer of claim 2 wherein said variable rate transition means is further responsive to another of said control signals for varying said transition rate.

4. The speech synthesizer of claim 1 wherein said programmable rate control means is further adaptable to vary the overall speech rate of said audio output while preserving the relative variations in the duration of production of each phoneme as determined by said one control signal.

* * * * *

UNITED STATES PATENT AND TRADEMARK OFFICE

CERTIFICATE OF CORRECTION

PATENT NO. : 4,301,328

DATED : November 17, 1981

INVENTOR(S) : Mark V. Dorais

It is certified that error appears in the above—identified patent and that said Letters Patent is hereby corrected as shown below:

Col. 1, line 62, "test-to-audio" should be --text-to-audio--.
Col. 2, line 57, "tht" should be --that--.
Col. 5, line 39, "pusles" should be --pulses--.
Col. 5, line 45, "Althrough" should be --Although--.
Col. 8, line 68, "Fϕ" should be --FØ--.
Col. 9, line 31, after "F3" delete "," and insert -- + --.
Col. 10, line 57, "recalistically" should be --realistically--.
Col. 12, line 10, "soemwhat" should be --somewhat--.
Col. 12, line 58, "musculture" should be --musculature--.
Col. 13, line 4, "o" should be --of--.
Col. 13, line 24, "ingtegrator" should be --integrator--.
Col. 14, line 58, " "high-pole" " should be --high-pole--.
Col. 15, line 20, "benoted" should be --be noted--.
Col. 15, line 30, "l" should be --I--.
Col. 15, line 33, "ll" should be --II--.
Col. 17, line 27, "gnerated" should be --generated--.

UNITED STATES PATENT AND TRADEMARK OFFICE

CERTIFICATE OF CORRECTION

PATENT NO. : 4,301,328

DATED : November 17, 1981

INVENTOR(S) : Mark V. Dorais

It is certified that error appears in the above—identified patent and that said Letters Patent is hereby corrected as shown below:

Col. 17, line 33, "Fe" should be -- F4 --.
Col. 17, line 48, "103" should be --108--.
Col. 18, line 46, "varing" should be --varying--.
Col. 19, line 23, "2 7" should be --$2^7$--.
Col. 19, line 57, "III" should be --HI--.
Col. 19, line 58, "III" should be --HI--.
Col. 21, line 31, "to" should be --and--.
Col. 21, line 32, "III" should be --HI--.
Col. 22, line 40, "speed" should be --speech--.
Col. 22, line 67, "sound" should be --second--.
Col. 24, line 44, "(FD)" should be --(FD')--.
Col. 25, line 10, "hus" should be --thus--.

Signed and Sealed this

Sixth Day of July 1982

[SEAL]

Attest:

GERALD J. MOSSINGHOFF

Attesting Officer

Commissioner of Patents and Trademarks